US010731292B2

(12) United States Patent
Watkins

(10) Patent No.: US 10,731,292 B2
(45) Date of Patent: Aug. 4, 2020

(54) AERODYNAMIC FLYER BOW

(71) Applicant: KEIR Manufacturing, Inc., Brevard, NC (US)

(72) Inventor: David Watkins, Brevard, NC (US)

(73) Assignee: KEIR Manufacturing, Inc., Brevard, NC (US)

( * ) Notice: Subject to any disclaimer, the term of this patent is extended or adjusted under 35 U.S.C. 154(b) by 85 days.

(21) Appl. No.: 15/960,270

(22) Filed: Apr. 23, 2018

(65) Prior Publication Data

US 2018/0363242 A1 Dec. 20, 2018

Related U.S. Application Data

(62) Division of application No. 14/804,274, filed on Jul. 20, 2015, now Pat. No. 9,976,252.

(60) Provisional application No. 62/027,190, filed on Jul. 21, 2014.

(51) Int. Cl.

| | |
|---|---|
| ***D07B 3/10*** | (2006.01) |
| ***D01H 7/26*** | (2006.01) |
| ***D07B 7/04*** | (2006.01) |

(52) U.S. Cl.

CPC ..... *D07B 3/103* (2013.01); *D01H 7/26* (2013.01); *D07B 7/04* (2013.01)

(58) Field of Classification Search

CPC ..... D07B 3/103; D01H 7/26; D01H 7/30

See application file for complete search history.

(56) References Cited

U.S. PATENT DOCUMENTS

| | | | |
|---|---|---|---|
| 6,451 | A | 5/1849 | Abbott |
| 81,064 | A | 8/1868 | Bolster |
| 1,371,261 | A | 3/1921 | Price |
| 1,512,220 | A | 10/1924 | Harnett |
| 1,685,533 | A | 9/1928 | Bouvier |
| 2,599,356 | A | 6/1952 | Wild |
| 3,019,590 | A | 2/1962 | Brame |
| 3,413,795 | A | 12/1968 | Breuning |
| 3,793,819 | A | 2/1974 | Madalozzo et al. |

(Continued)

FOREIGN PATENT DOCUMENTS

| | | |
|---|---|---|
| CH | 618 486 | 7/1980 |
| EP | 569730 | 11/1993 |

(Continued)

OTHER PUBLICATIONS

Miscellaneous Commercial Literature, 3 pages, (date unknown).

(Continued)

*Primary Examiner* — Shaun R Hurley

(74) *Attorney, Agent, or Firm* — Finnegan, Henderson, Farabow, Garrett & Dunner, LLP

(57) ABSTRACT

A flyer bow providing reduced drag during a wire processing operation is provided. The flyer bow may include an elongate arcuate body having a middle portion, and first and second end portions at opposite ends of the middle portion. The elongate arcuate body may be configured to be rotated about an axis of rotation, the middle portion may include an inner surface, an outer surface, a leading edge, and a trailing edge, the inner surface and the outer surface may cooperate to form a cross section, and at least one centerline of the cross section may include a radius of curvature substantially equal to a distance between the elongate arcuate body at the location of the at least one centerline and the axis of rotation.

14 Claims, 12 Drawing Sheets

(56) References Cited

U.S. PATENT DOCUMENTS

| | | | |
|---|---|---|---|
| 3,945,182 | A | 3/1976 | Dover et al. |
| 4,072,003 | A | 2/1978 | Mino |
| 4,256,268 | A | 3/1981 | Fahrbach |
| 4,302,924 | A | 12/1981 | Faulstich |
| 4,434,945 | A | 3/1984 | Hamane et al. |
| 5,509,260 | A | 4/1996 | Derdeyn |
| 5,671,878 | A | 9/1997 | Kawasaki |
| 5,809,763 | A | 9/1998 | Rowlands et al. |
| 6,223,513 | B1 | 5/2001 | Post et al. |
| 6,289,661 | B1 | 9/2001 | Boland |
| 6,865,875 | B2 | 3/2005 | Watkins |
| 7,121,076 | B2 | 10/2006 | Priegelmeir et al. |
| 7,165,387 | B2 | 1/2007 | Voge et al. |
| 8,893,464 | B2 | 11/2014 | Laemmermann et al. |
| 2002/0112462 | A1 | 8/2002 | Bock |
| 2004/0172932 | A1 | 9/2004 | Watkins |
| 2006/0000198 | A1 | 1/2006 | Priegelmeir et al. |
| 2006/0196163 | A1 | 9/2006 | Voge |
| 2014/0196431 | A1 | 7/2014 | Boujaada et al. |

FOREIGN PATENT DOCUMENTS

| | | |
|---|---|---|
| JP | 53028743 | 3/1978 |
| JP | 5-247 861 | 9/1993 |
| JP | 06 346388 | 12/1994 |
| JP | 09 158070 | 6/1997 |
| JP | 2000017590 | 1/2000 |
| JP | 2001254285 | 9/2001 |
| JP | 2009242977 | 10/2009 |

OTHER PUBLICATIONS

Brochure, Kamatics—Flyer Bow—Line Card, Kamatics Corporation, 2 pages (date unknown).

Commercial Literature, Kamatics—Clamp on Guide System, Kamatics Corporation, 1 page (date unknown).

Commercial Literature, Kamatics—Composite Flyer Bows, Kamatics Corporation, 2 pages (date unknown).

AERODYNAMIC FLYER BOW

CROSS-REFERENCE TO RELATED APPLICATIONS

This application is a division of U.S. application Ser. No. 14/804,274, filed Jul. 20, 2015, and claims the benefit of priority under 35 U.S.C. § 119(e) to U.S. Provisional Application No. 62/027,190, filed on Jul. 21, 2014, the disclosures of the above applications are expressly incorporated herein by reference in its their entirety.

TECHNICAL FIELD

The present disclosure relates to flyer bows for use in wire bunching/twisting processes. More particularly, the disclosure relates to aerodynamically shaped flyer bows for reducing power draw and increasing processing speeds.

BACKGROUND

Twisted cables may be manufactured through the use of wire processing machines employing flyer bows. Wire processing machines with flyer bows may be used to make twisted cables for a wide variety of uses. Flyer bows may be used with pairing, tripling, quadding, bunching, stranding, wrapping, and twisting machines for wires. An exemplary embodiment of a twisting machine employing a flyer bow is disclosed and described in U.S. Pat. No. 3,945,182, the contents of which are hereby incorporated by reference.

Flyer bows are frequently arcuate along their length and are frequently elongated along their cross section. Flyer bows may include wire guides configured to guide the wire to be twisted. In use, a flyer bow is rotated about an axis of rotation, carrying the guided wire with it in rotation. This rotation permits the wrapping, stranding, or twisting of the guided wire as a twisted cable is produced.

Higher productivity from bunching/twisting machines with flyer bows may be achieved by increasing the speed of rotation of the flyer bow. At high rotation speeds, however, drag on the bow becomes substantial, requiring more energy and more powerful equipment to maintain high speeds. Furthermore, potential turbulence created at high speeds results in greater wear to machinery as well as significant noise.

SUMMARY

Aspects of the present disclosure provide a flyer bow having an aerodynamic shape, which may reduce drag on the flyer bow. Reduced drag may result in lower power consumption during a bunching/twisting process and/or higher achievable wrapping speeds, which may result in greater manufacturing throughput.

Some embodiments include a flyer bow for processing wires. The flyer bow may include an elongate arcuate body having a middle portion, and first and second end portions at opposite ends of the middle portion. The elongate arcuate body may be configured to be rotated about an axis of rotation, the middle portion may include an inner surface, an outer surface, a leading edge, and a trailing edge, the inner surface and the outer surface may cooperate to form a cross section, and at least one centerline of the cross section may include a radius of curvature substantially equal to a distance between the elongate arcuate body at the location of the at least one centerline and the axis of rotation.

Some embodiments include a flyer bow for processing wires. The flyer bow may include an elongate arcuate body configured to be rotated about an axis of rotation, the elongate arcuate body having a middle portion, and first and second end portions at opposite ends of the middle portion. The middle portion may have an inner surface, an outer surface, a leading edge, a trailing edge, at least one recess for receiving wires to be twisted located between the inner surface and the outer surface, and at least one slot in at least one of the inner and the outer surface. The slot may adjoin the recess, and the inner surface and the outer surface may cooperate to form a cross section.

DETAILED DESCRIPTION OF EXEMPLARY EMBODIMENTS

Reference will now be made in detail to exemplary embodiments of the present disclosure, examples of which are illustrated in the accompanying drawings. Wherever possible, the same reference numbers will be used throughout the drawings to refer to the same or like parts. These embodiments are described in sufficient detail to enable those skilled in the art to practice the disclosed embodiments and it is to be understood that other embodiments may be utilized and that changes may be made without departing from the scope of the disclosed embodiments. The following detailed description, therefore, is not to be interpreted in a limiting sense.

Flyer bows consistent with the present disclosure may be used for processing wires in, for example, pairing, tripling, quadding, bunching, stranding, wrapping, and twisting operations. Many of these terms, for example, bunching and twisting, may be used interchangeably in the art. Thus, for example, a flyer bow wire twisting operation may be substantially similar to a flyer bow wire bunching operation. As discussed herein, particular operations may be described and particular terms may be used for exemplary purposes only. It is understood that the flyer bows disclosed herein may be used for any and all of the above described wire processing techniques.

Figure 1:
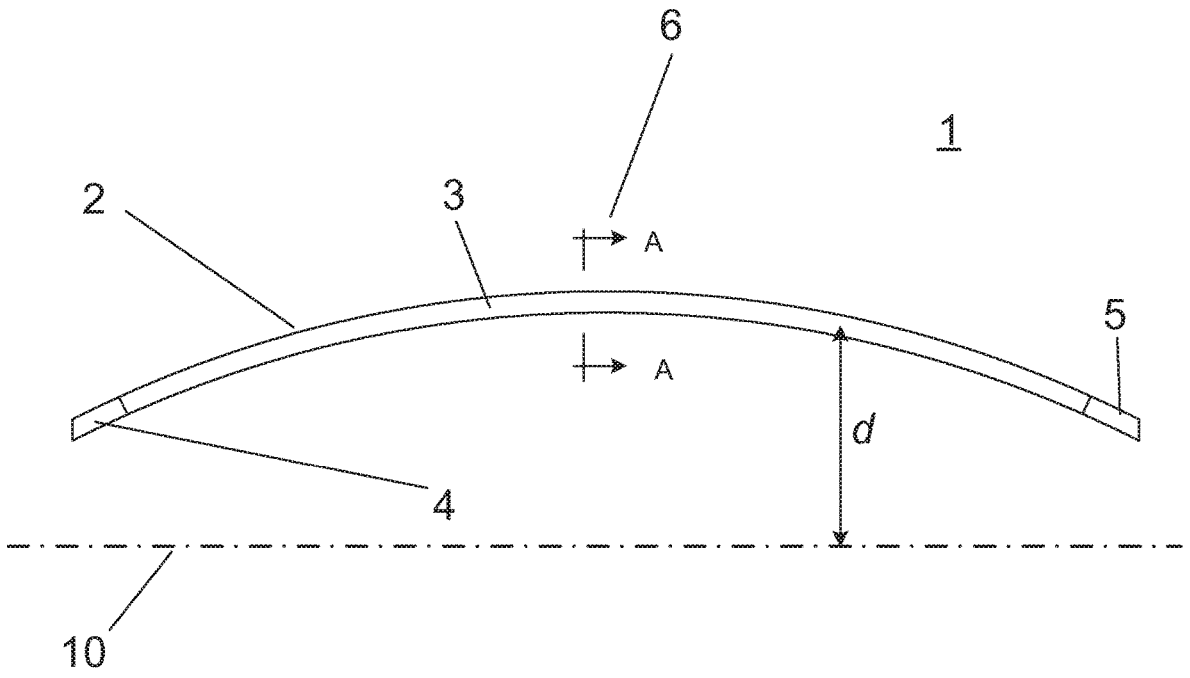
FIG. 1 illustrates a flyer bow in profile.

Referring to FIG. 1, a flyer bow 1 for twisting wires may include an elongate arcuate body 2. The elongate arcuate body 2 may include a middle portion 3 and first and second end portions 4, 5, each disposed at an opposite end of middle portion 3. Middle portion 3 may extend for any length of arcuate body 2, including, for example, greater than 50%, greater than 60%, greater than 70%, greater than 80%, greater than 90%, greater than 95% and greater than 99%. End portions 4, 5, may shaped or fitted as required for mounting flyer bow 1 to rotors of a twisting machine (not shown). When operated in a wire twisting process, flyer bow 1 may rotate about axis of rotation 10. When rotated, each location along elongated arcuate body 2 may describe a circle having a radius equal to a distance d between a center of the elongate arcuate body at the location axis of rotation. The circle of radius d is not illustrated in FIG. 1 because it would be perpendicular to the drawing page. Distance d, which may vary continuously along the length of elongated arcuate body 2, is illustrated by example in FIG. 1.

Figure 2:
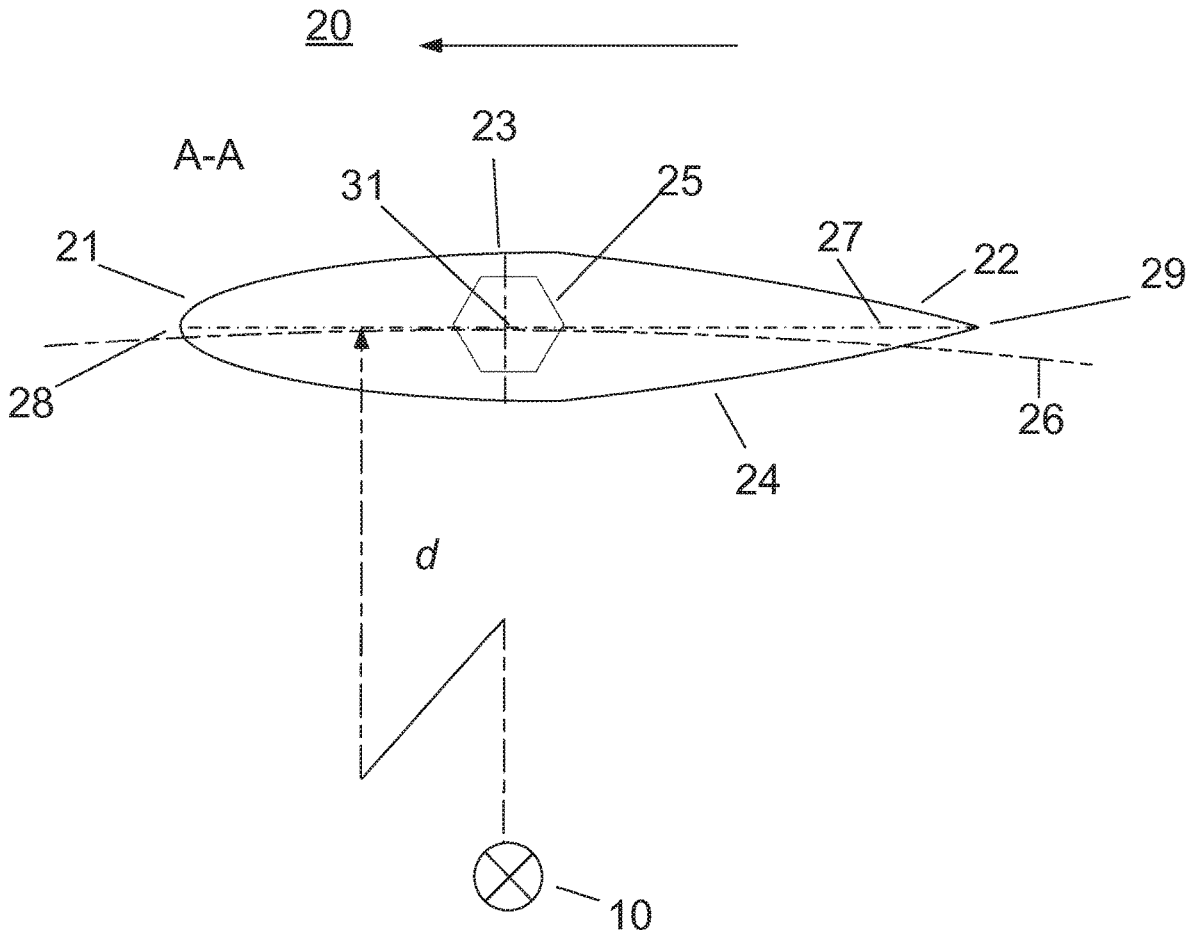
FIG. 2 illustrates a cross section view of an aerodynamic flyer bow.
Figure 3:
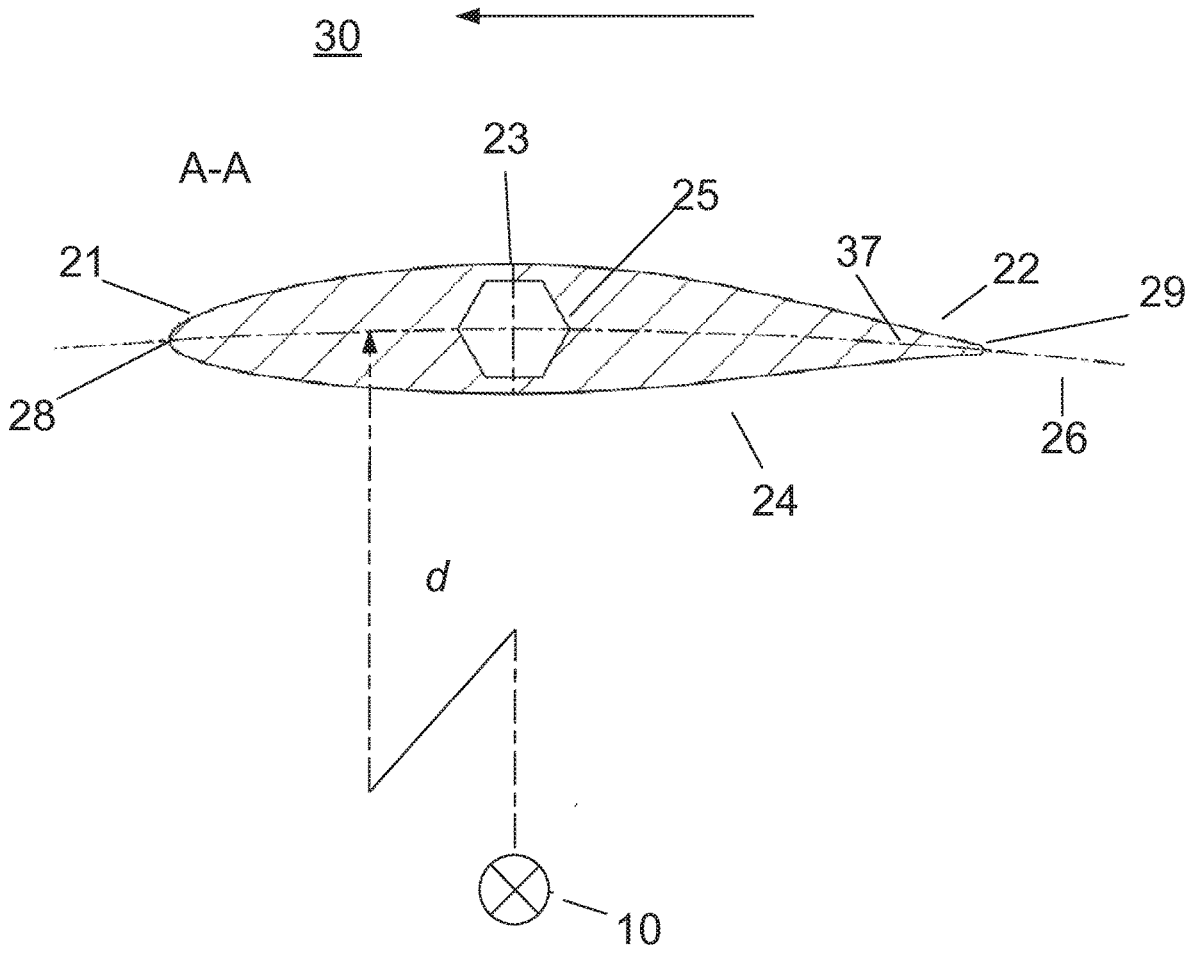
FIG. 3 illustrates a cross section view of a curved aerodynamic flyer bow.

Flyer bow 1 may also include a cross section 6, marked as A-A in FIG. 1, and further illustrated in FIGS. 2 and 3. Cross section 6 may be constant throughout middle portion 3, or may vary according to a position along middle portion 3.

Flyer bow 1 may include various means for guiding wires during a wrapping operation. Flyer bow 1 may include surface mount wire guides, mounted externally on any surface of elongate arcuate body 2 and configured to guide a wire to be twisted or wrapped. Such surface mount wire guides may be aerodynamically designed so as not to add significant drag to the rotating flyer bow. Surface or external mount wire guides are discussed in greater detail with respect to FIGS. 4-7. Flyer bow 1 may further include at least one wire recess, which is configured to guide a wire to be wrapped or twisted along an anterior of elongated arcuate body 2 during a wire bunching or twisting operation. When wire recesses are employed, elongate arcuate body 2 may further include wire entrance and exit holes, which may facilitate the entry and exit of the wire from the at least one wire recess.

FIG. 2 illustrates a cross section 20 of flyer bow 1 within middle portion 3. Although illustrated as being located at cross section A-A, cross section 20 may be located at any point along middle portion 3. Cross section 20 may include leading edge 21, trailing edge 22, inner surface 24, outer surface 23, and centerline 27. Centerline 27 may connect a leading edge center point 28 a trailing edge center point 29. FIG. 2 further illustrates a recess 25.

During operation, cross section 20 of flyer bow 1 may travel path 26, described by a circle of radius d having axis of rotation 10 as its center. As illustrated in FIG. 2, circular path 26 is defined as the path described by cross section rotation point 31 during flyer bow rotation. Cross section rotation point 31 is the point where centerline 27 of cross section 20 is tangential to circular path 26.

As the flyer bow rotates, inner surface 24 is oriented to face the center of the circle and outer surface 23 is oriented to face away from the center of the circle. Flyer bow 1 may travel in the direction of leading edge 21, while trailing edge 22 follows behind.

As illustrated in FIG. 2, cross section 20 of middle portion 3 may have an aerodynamic shape, such as that of an airfoil, provided by cooperation between inner surface 24 and outer surface 23. The aerodynamic shape may serve to reduce drag on rotating flyer bow 1, thus making it possible to achieve the highly desirable result of operating the flyer bow at either a higher speed of rotation, and thereby increasing productivity, or operating the flyer bow at a given speed while consuming less power, thereby reducing operating costs. Because middle portion 3 of elongate arcuate body 2 travels in a circle having a radius that is greater than radius d during operation, it travels at a higher speed than end portions 4, 5. Thus, if end portions 4, 5 do not include an aerodynamic cross section, it may not significantly affect the drag on flyer bow 1.

In some embodiments, cross section 20 may provide neutral lift when flyer bow 1 is rotated about axis of rotation 10. As illustrated in FIG. 2, cross section 20 may have a symmetric air foil shape. Such a symmetric shape may provide neutral lift to the cross section 20 during operation. In a symmetric design, centerline 27 may be equidistant from inner surface 24 and outer surface 23 at any point along its length. That is, the forces on inner surface 24 may be approximately in balance with the forces on outer surface 23. Although a symmetric shape is illustrated in FIG. 2, symmetry is not required to design an air foil with neutral lift. Neutral lift air foils may be provided in a variety of shapes and designs. A neutral lift air foil may be beneficial for at least several reasons. For example, the opposing forces on inner surface 24 and outer surface 23 may stabilize flyer bow 1, thus reducing noise, vibration, and machine wear. Additionally, neutral lift may be beneficial by reducing bearing loads.

In some embodiments, cross section 20 may be shaped such that at least one of the inner surface and the outer surface may provide lift. Unbalanced lift provided by one of surfaces 23, 24 may be beneficial to counteract other forces generated during a twisting operation. For example, centripetal forces caused by the rotation of flyer bow 1 may be at least partially counteracted by lift provided by outer surface 23.

In some embodiments, leading edge 21 may have a larger radius than trailing edge 22. Such a larger radius in the leading edge may serve to decrease drag on and increase stability of flyer bow 1.

In some embodiments, at least one centerline of a cross section may have a radius of curvature substantially equal to a distance between the elongate arcuate body at the location of the at least one centerline and the axis of rotation. This feature is shown in FIG. 3, which illustrates an exemplary curved airfoil cross section consistent with the present disclosure.

As described above, each portion of flyer bow 1 describes a circular travel path 26 during rotation of flyer bow 1. As illustrated in FIG. 2, however, in some cross sections 20, centerline 27 does not coincide with travel path 26. As illustrated, leading edge center point 28 and trailing edge center point 29 are each at a greater distance from axis of rotation 10 than is travel path 26. Because cross section 20 is constantly being pulled in a circle during a wire twisting process, a force imbalance on flyer bow 1 may be created. Such a force imbalance may result in increased drag, and, therefore, increased power requirements to maintain a certain speed.

Returning now to FIG. 3, an airfoil having exemplary curved cross section 30 may serve to decrease drag as compared to straight cross section 20. As illustrated in FIG. 3, centerline 37 of cross section 30, which connects leading edge center point 28 and trailing edge center point 29, may have a radius of curvature substantially equal to a travel path 26. As discussed above, travel path 26 may describe a circle of radius d, where d is equal to a distance between the elongate arcuate body and the axis of rotation at the location of cross section 30. In cross section 30, there is no cross section rotation point 31 that describes path 26, because the entirety of centerline 37 may substantially correspond to the travel path 26. Conforming centerline 37 to rotational travel path 26 may serve to decrease drag and/or increase stability of flyer bow 1.

In some embodiments, a plurality of centerlines, each at a different cross sectional location along middle portion 3, may each correspond to the travel path described by that particular cross section. That is, because of the arcuate nature of elongate arcuate body 2, each cross sectional location may describe a circle of a different radius d. At each location, a radius of curvature of a centerline may be substantially equal to the distance between the elongate arcuate body at the location of the centerline and the axis of rotation. Thus, middle portion 3 may include a plurality of centerlines, and the radii of curvature of the plurality of centerlines may vary according to the distance between the elongate arcuate body and the axis of rotation at a location where each of the plurality of centerlines is located. The plurality of centerlines may be an infinite plurality, which vary gradually throughout the length of middle portion 3. The plurality of centerlines may also be a discrete, numbered plurality.

Figure 4:
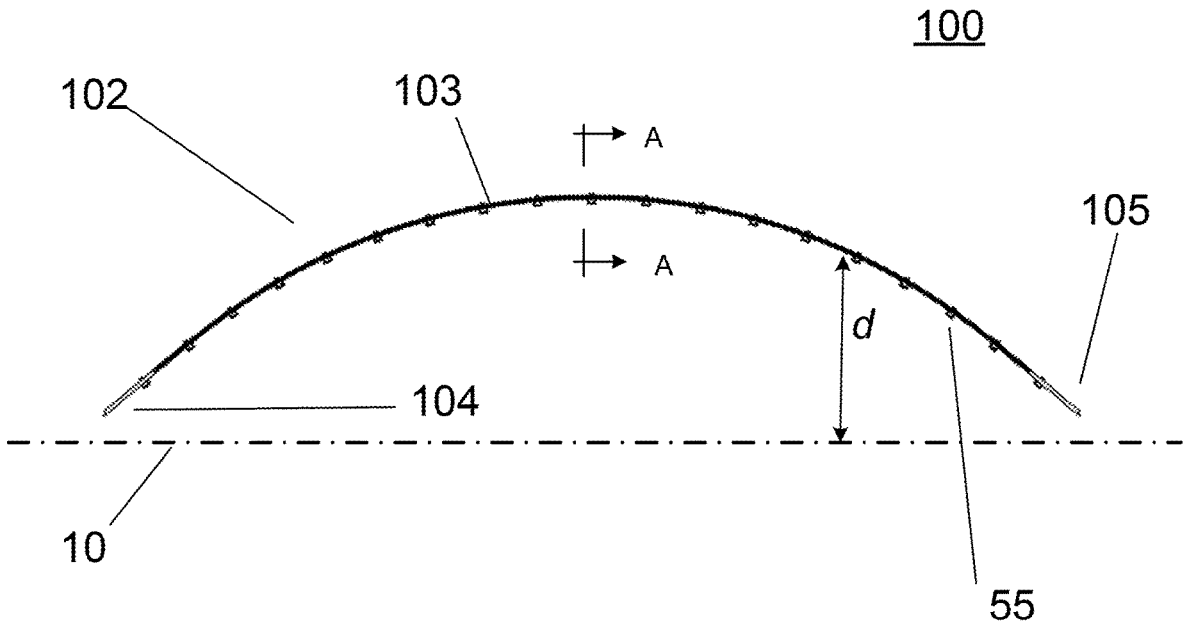
FIG. 4 illustrates a flyer bow in profile including at least one externally mounted wire guide.
Figure 5:
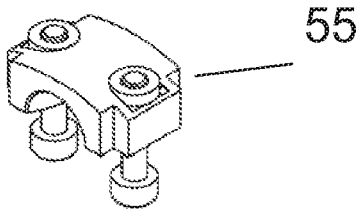
FIG. 5 illustrates an exemplary externally mounted wire guide.

In some embodiments consistent with the present disclosure, flyer bow 1 may include external surface mount wire guides for guiding a wire to be wrapped during a twisting operation. FIGS. 4-7 illustrate exemplary embodiments including surface mount wire guides. FIG. 4 illustrates a profile view of an exemplary flyer bow including externally mounted wire guides. Similarly to flyer bow 1 illustrated in FIG. 1, flyer bow 100, as illustrated in FIG. 4 may include an elongate arcuate body 102. The elongate arcuate body 102 may include a middle portion 103 and first and second end portions 104, 105, each disposed at an opposite end of middle portion 103. Flyer bow 100 may also include at least one externally mounted wire guide 55 along its length. Flyer bow 100 may rotate about axis of rotation 10 when employed in a twisting process. Flyer bow 100 may also include at least one surface or external mount wire guide 55. An exemplary externally mounted wire guide 55 is illustrated in greater detail in FIG. 5

Figure 6:
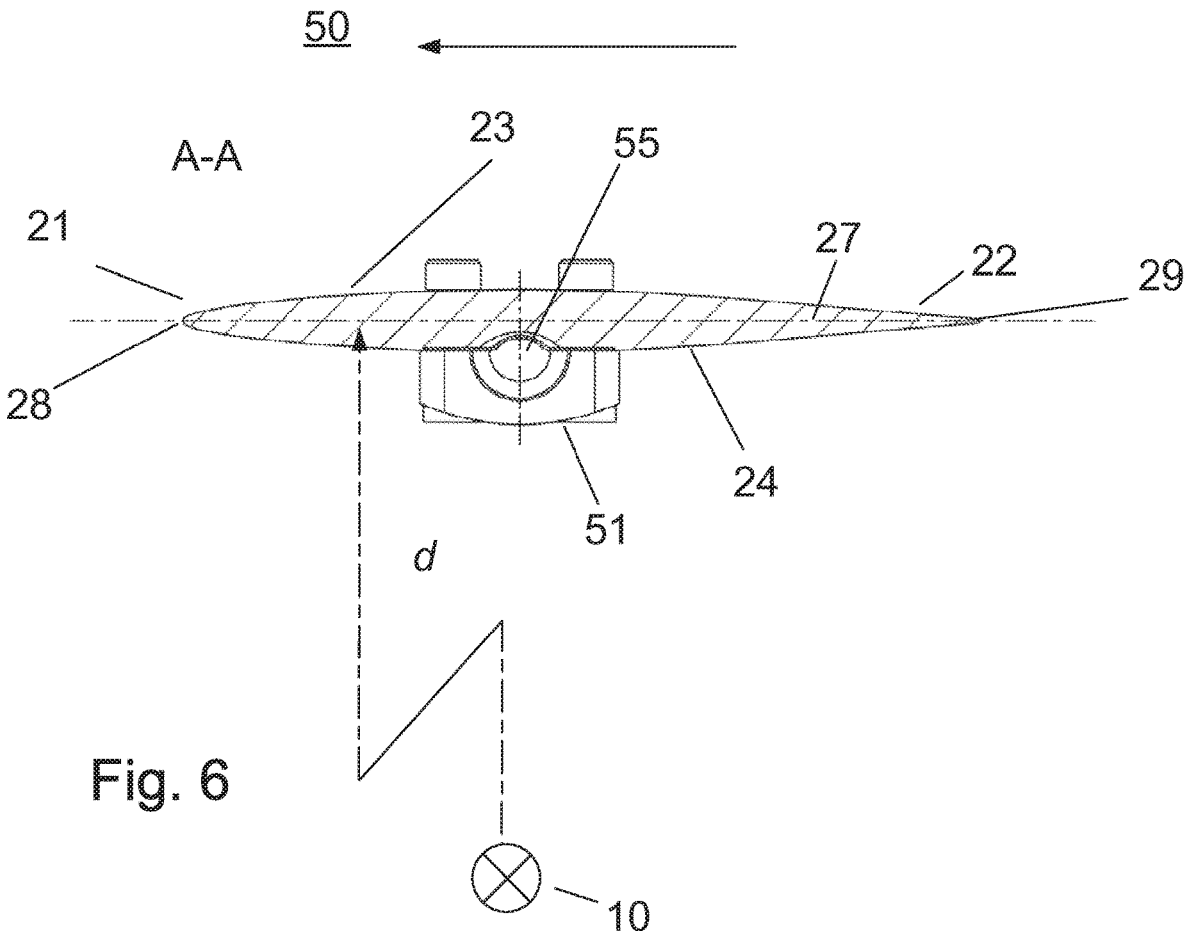
FIG. 6 illustrates a cross section view of an aerodynamic flyer bow including at least one surface mount wire guide.
Figure 7:
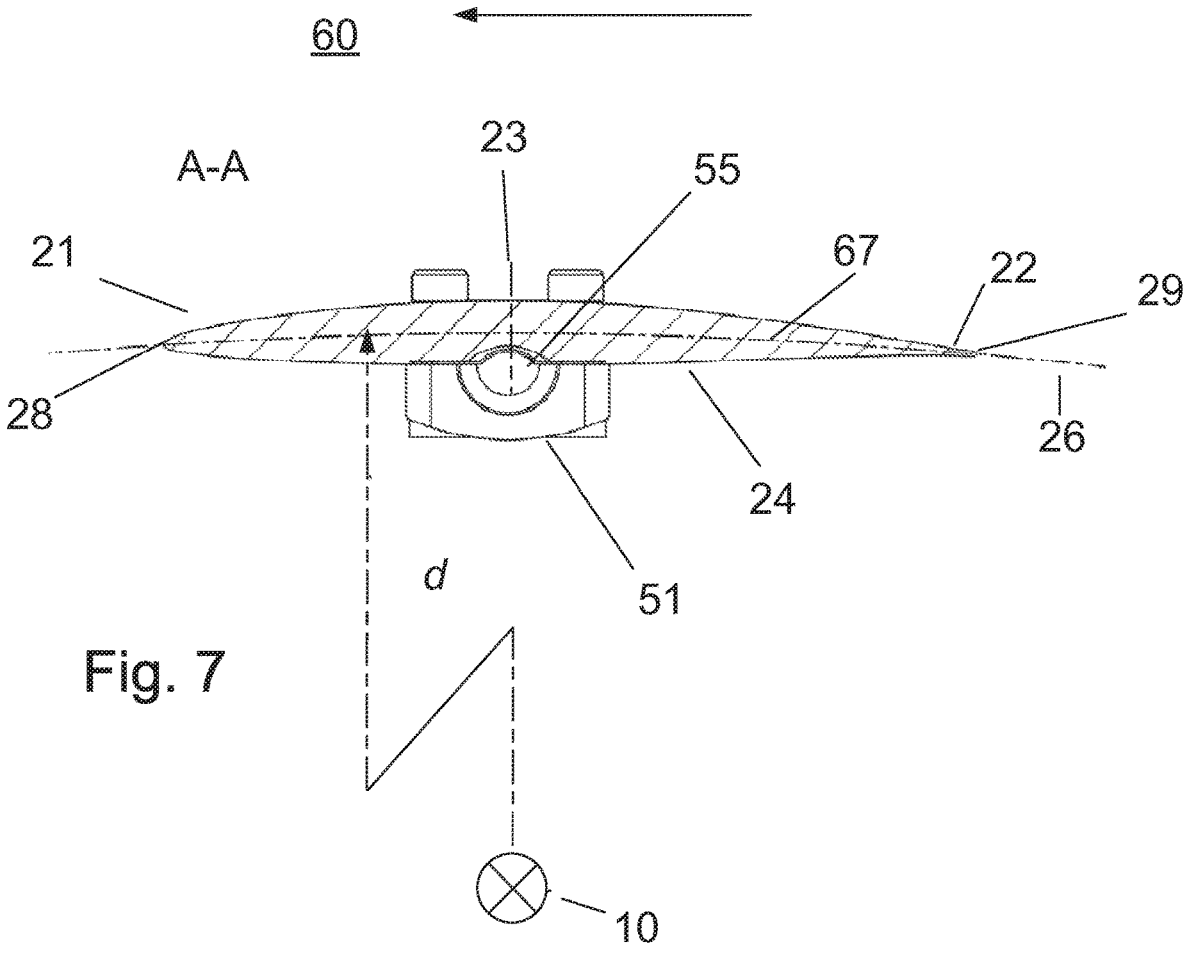
FIG. 7 illustrates a cross section view of a curved aerodynamic flyer bow having at least one wire guide.

FIG. 6 illustrates a cross section view of aerodynamic flyer bow 100 including at least one surface mount wire guide. FIG. 7 illustrates a cross section view of a curved aerodynamic flyer bow 100 having at least one wire guide.

As illustrated in FIG. 6, elongate arcuate body 102 may include a cross section 50. Cross section 50 may include recess 55 formed on inner surface 24. Elongate arcuate body 102 may further include at least one externally mounted wire guide 51 along its length, configured to cooperate with recess 55 to receive a wire to be guided during a twisting operation.

As illustrated in FIG. 7, elongate arcuate body 102 may include a cross section 60. Cross section 60 may include a curved aerodynamic cross section, as previously described with respect to FIG. 2. Cross section 60 may further include recess 55 formed on inner surface 24. Elongate arcuate body 102 may additionally include at least one externally mounted wire guide 51 along its length, the at least one wire guide 51 being configured to cooperate with recess 55 to receive a wire to be guided during a twisting operation.

In some embodiments consistent with the present disclosure, at least one slot in at least one of inner surface 24 and outer surface 23 may be provided. The slot may adjoin with recess 25 for designs where wire is guided internally within the bow. FIGS. 8*a-d* illustrate exemplary embodiments of flyer bow 1 including such slots 41.

As flyer bow 1 rotates, wire may be guided internally through recess 25. High wire throughput speeds require wire to travel through recess 25 at high velocities. Such high velocities may create dust and friction between the wire and the edges of recess 25. In some embodiments, flyer bow 1 may include a replaceable wear strip to prevent damage to flyer bow 1. As dust accumulates, it may make it more difficult for wire to travel through recess 25. Thus, at least one slot 41 may be provided in elongate arcuate body 2 and adjoin with recess 25 to permit dust to escape. Multiple slots 41 may be provided along the length of elongate arcuate body 2.

Figure 8A:
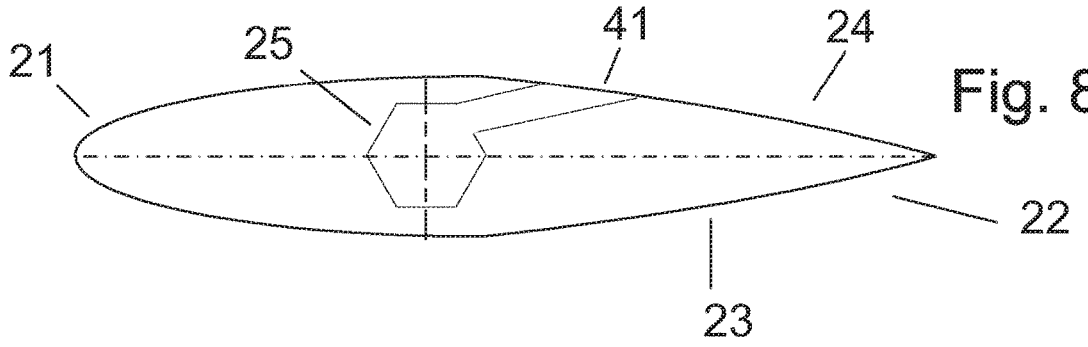
FIGS. 8*a-d* illustrate a cross section of a flyer bow having surface slots.
Figure 8B:
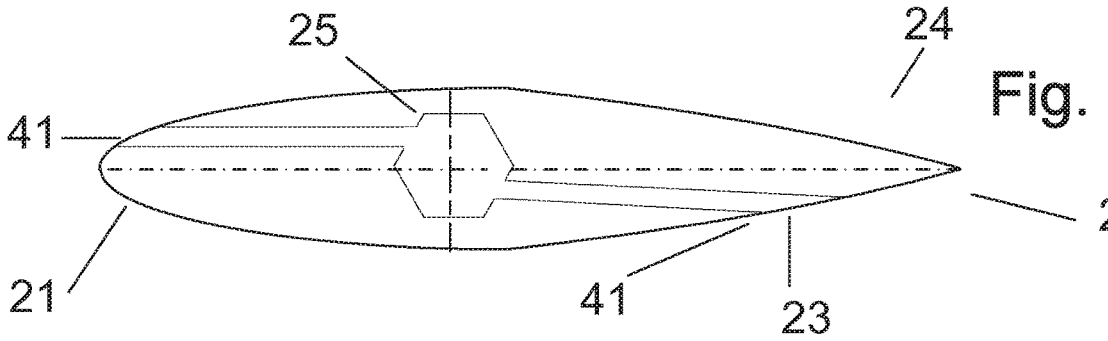
Figure 8C:
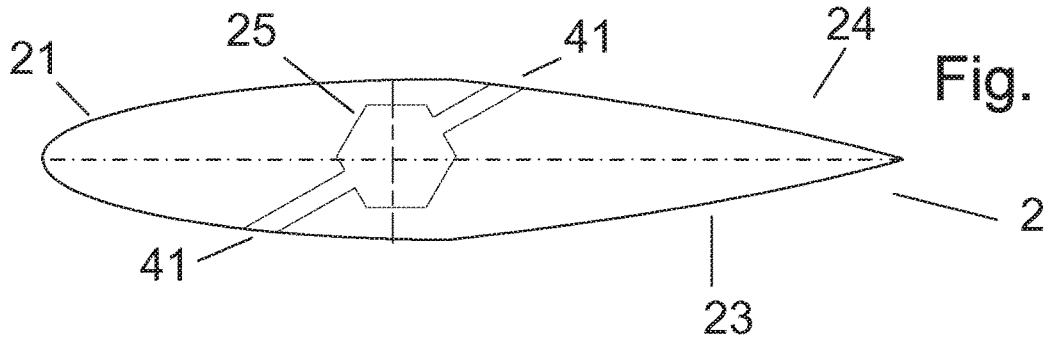
Figure 8D:
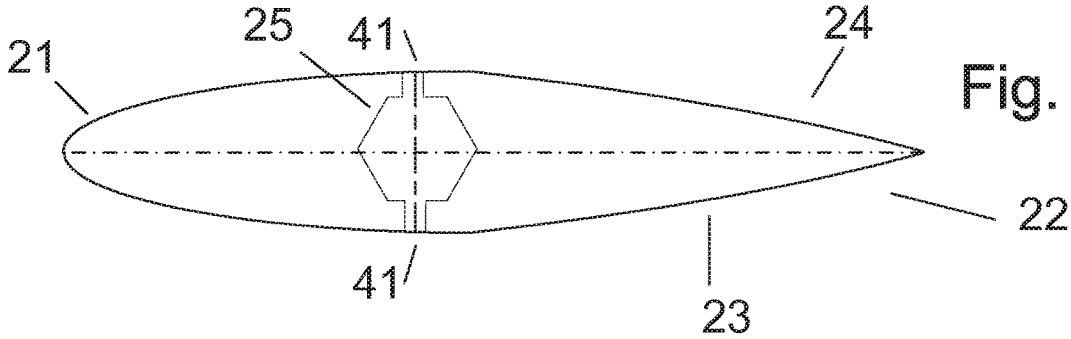

FIGS. 8*a-d* illustrate various configurations of slots 41. FIGS. 8*a-d* are exemplary only, and are not intended to limit the configurations of slots 41. As illustrated in FIG. 8*a*, slot 41 may be provided in outer surface 24. As illustrated in FIG. 8*b*, slots 41 may be provided in both inner surface 23 and outer surface 24. Additionally, two slots 41 may cooperate to form a through-passage. Also as illustrated in FIG. 8*b*, at least one slot 41 may be disposed on leading edge 21 and at least one slot 41 may be disposed on trailing edge 22. FIGS. 8*c* and 8*d* illustrate further combinations of potential slot 41 locations.

Figure 9:
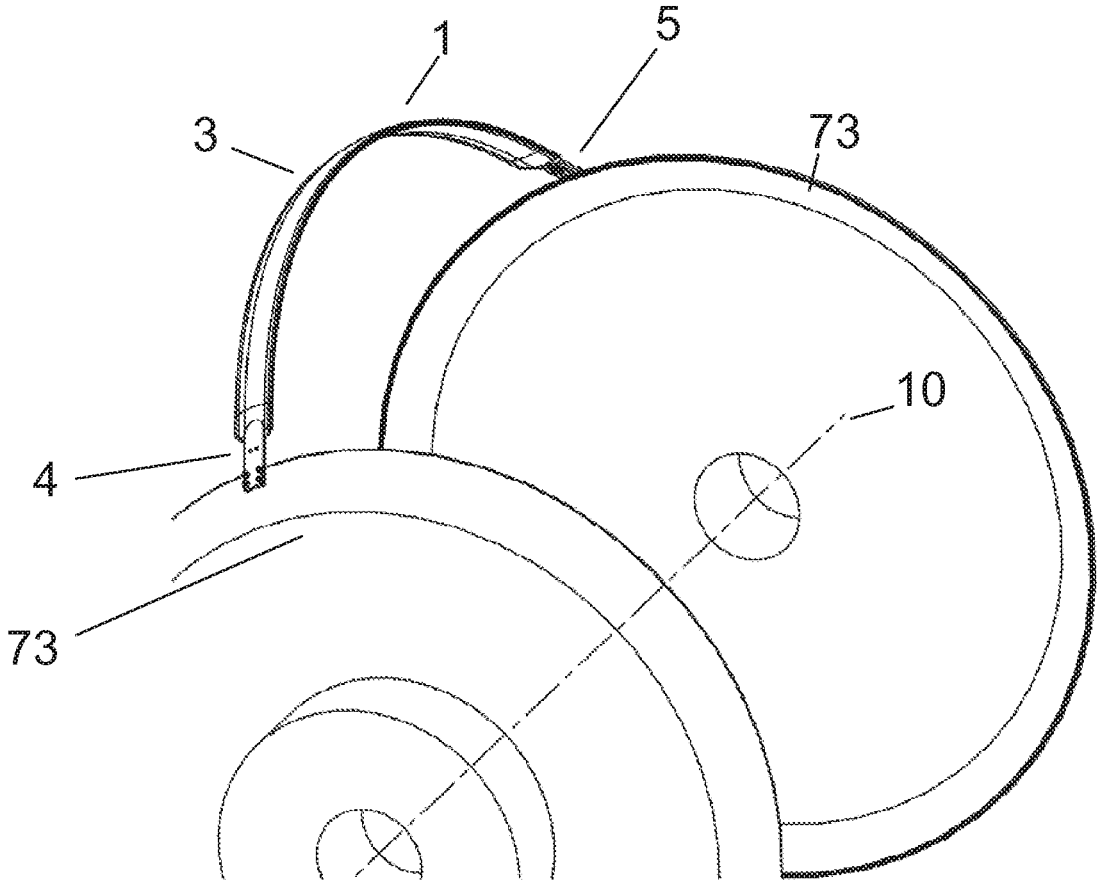
FIG. 9 illustrates an exemplary flyer bow mounted to rotors of a twisting machine.

FIG. 9 illustrates a flyer bow mounted to rotors of a wire processing machine. As illustrated in FIG. 9, flyer bow 1 may be mounted to rotors 73 of a wire processing machine. Rotors 73 may rotate about axis of rotation 10, corresponding to the axis of rotation of flyer bow 1.

Exemplary embodiments of flyer bows discussed herein include flyer bows having airfoil shaped cross sections. For example, FIG. 3 illustrates a flyer bow having an airfoil cross section wherein at least one centerline of an airfoil shaped cross section may have a radius of curvature substantially equal to a distance between the elongate arcuate body at the location of the at least one centerline and the axis of rotation. FIG. 6 illustrates an exemplary flyer bow having an airfoil shaped cross section having externally mounted wire guides. FIGS. 8*a*-8*d* illustrate exemplary flyer bows of airfoil shaped cross sections including slots or recesses that communicate with an internal wire guide. The features and elements discussed herein, however, are not limited to flyer bows having airfoil shaped cross sections. All of the features and aspects of flyer bows discussed herein may be provided to flyer bows having alternative cross sections, for example, rectangular or elliptical. Some embodiments may include flyer bows having cross sections that are altered along the length of the flyer bow, e.g., rectangular at ends and air-foil shaped in the center. Some non-limiting examples are as follows.

Figure 10:
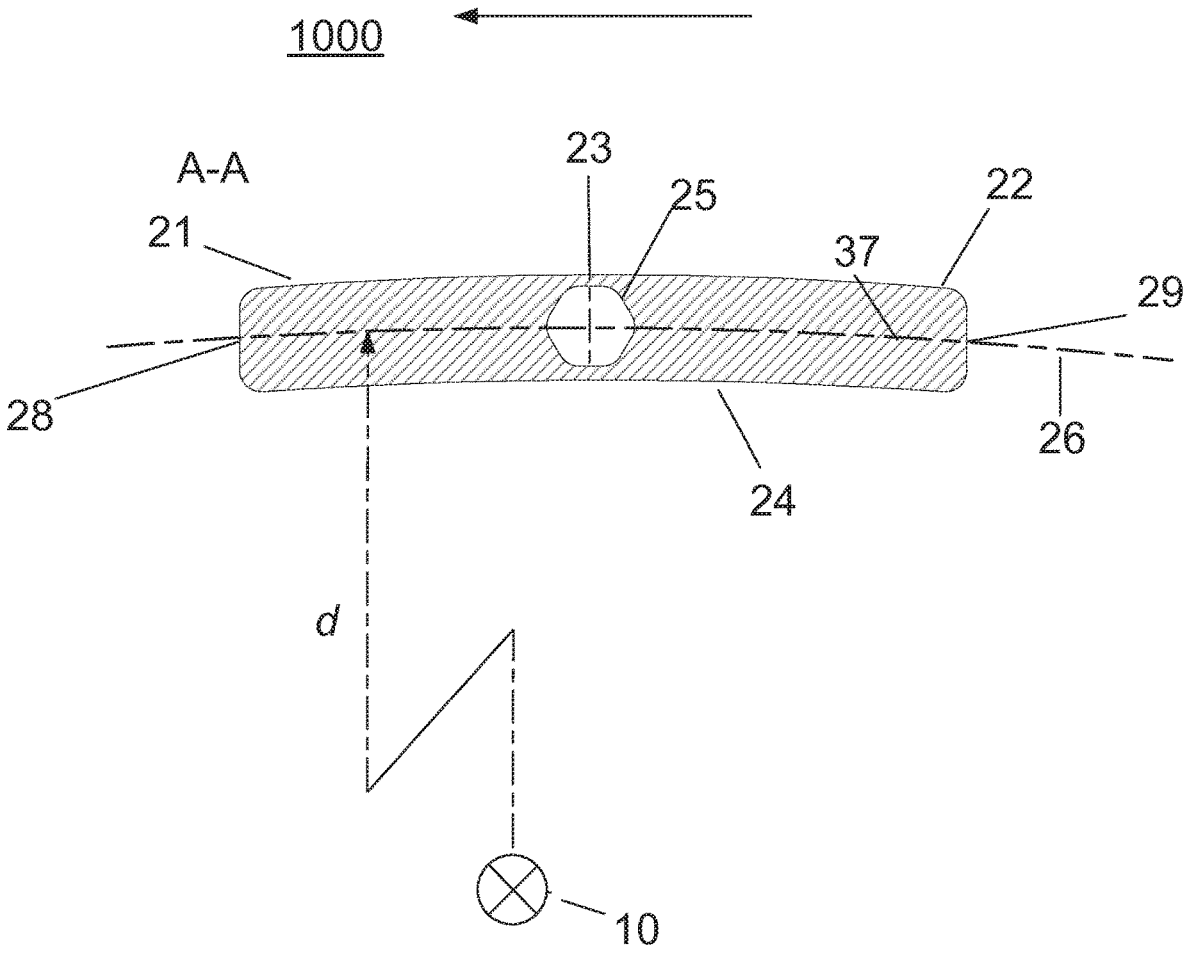
FIG. 10 illustrates an exemplary curved flyer bow consistent with the present disclosure.

FIG. 10 illustrates a flyer bow having an exemplary curved rectangular cross section 1000 and including at least one centerline having a radius of curvature substantially equal to a distance between the elongate arcuate body at the location of the at least one centerline and the axis of rotation. As illustrated in FIG. 10, curved rectangular cross section 1000 has rounded corners. In some embodiments, curved rectangular cross section 1000 may have sharp corners.

Figure 11:
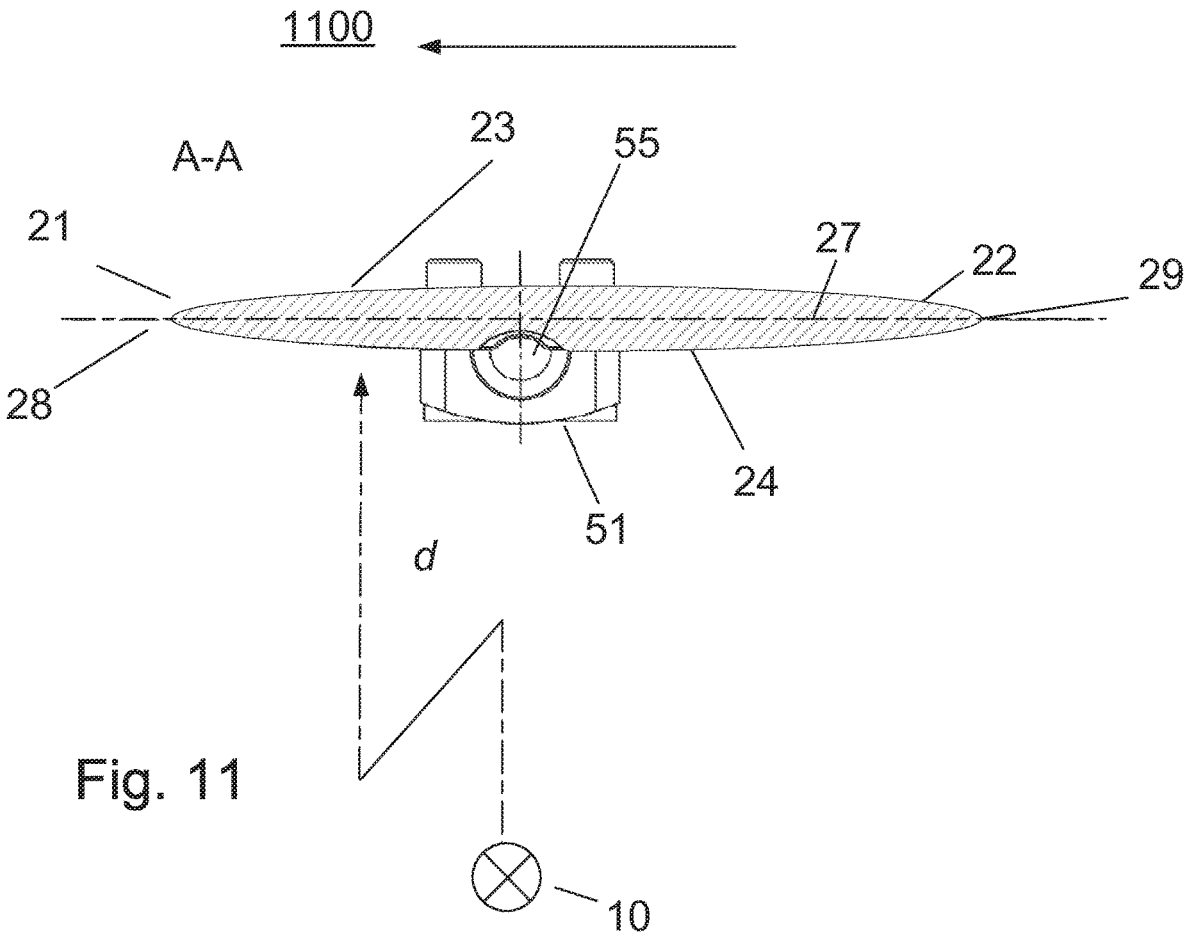
FIG. 11 illustrates an exemplary flyer bow including at least one surface mount wire guide consistent with the present disclosure.
Figure 12:
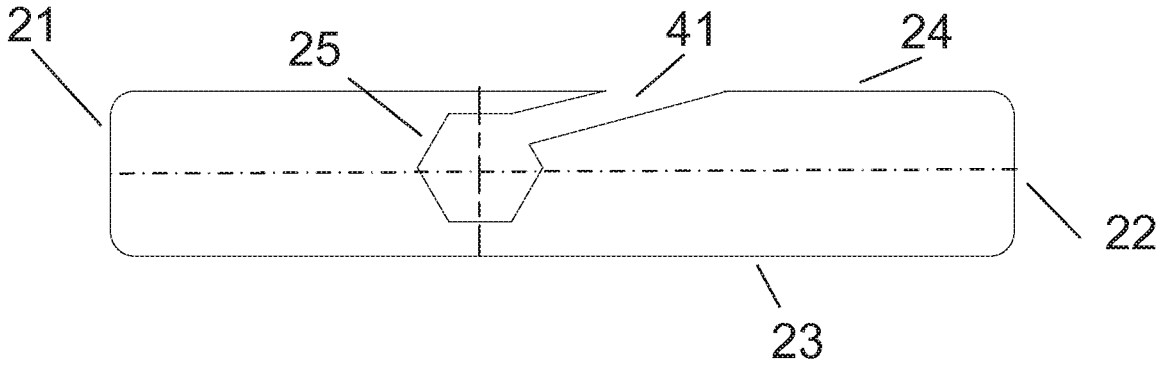
FIG. 12 illustrates an exemplary flyer bow including at least one surface slot consistent with the present disclosure.

FIG. 11 illustrates a flyer bow having an exemplary elliptical cross section 1100 and having externally mounted wire guides. FIG. 12 illustrates a flyer bow having an exemplary rectangular cross section 1200 and external slots communicating with an internal wire guide. These are just some examples of alternative cross section flyer bows to which the features and elements of this disclosure may be applied. A person of skill in the art will recognized additional cross sectional shapes to which features disclosed here-in may be applied.

Other embodiments of the present disclosure will be apparent to those skilled in the art from consideration of the specification and practice of the present disclosure.

Additional aspects of the disclosed embodiments are described in the following numbered paragraphs, which are part of this description. Each numbered paragraph stands on its own as a separate exemplary embodiment.

What is claimed is:

1. A flyer bow for processing wires, the flyer bow comprising:

an elongate arcuate body configured to be rotated about an axis of rotation, the elongate arcuate body having a middle portion, and first and second end portions at opposite ends of the middle portion;

wherein the middle portion has an inner surface, an outer surface, a leading edge, a trailing edge, at least one recess for receiving wires to be processed located between the inner surface and the outer surface, and at least one slot disposed on the trailing edge and in at least one of the inner and the outer surface, the slot adjoining with the recess, and wherein the inner surface and the outer surface cooperate to form a cross section.

2. The flyer bow of claim 1, wherein the at least one slot is located in the outer surface.

3. The flyer bow of claim 1, wherein the at least one slot is located in the inner surface.

4. The flyer bow of claim 1, wherein the at least one slot includes a first slot and a second slot, the first slot and the second slot cooperating with the recess to form a through-passage.

5. The flyer bow of claim 4, wherein the first slot is formed on the inner surface and the second slot is formed on the outer surface.

6. The flyer bow of claim 4, wherein the cross section includes an airfoil shape.

7. The flyer bow of claim 1, wherein the slot does not extend from the inner surface to the outer surface.

8. A flyer bow for processing wires, the flyer bow comprising:

an elongate arcuate body configured to be rotated about an axis of rotation, the elongate arcuate body having a middle portion, and first and second end portions at opposite ends of the middle portion;

wherein the middle portion has an inner surface, an outer surface, a leading edge, a trailing edge, at least one recess for receiving wires to be processed located between the inner surface and the outer surface, and at least one slot disposed on the leading edge and in at least one of the inner and the outer surface, the slot adjoining with the recess, and wherein the inner surface and the outer surface cooperate to form a cross section.

9. The flyer bow of claim 8, wherein the at least one slot is located in the outer surface.

10. The flyer bow of claim 8, wherein the at least one slot is located in the inner surface.

11. The flyer bow of claim 8, wherein the at least one slot includes a first slot and a second slot, the first slot and the second slot cooperating with the recess to form a through-passage.

12. The flyer bow of claim 11, wherein the first slot is formed on the inner surface and the second slot is formed on the outer surface.

13. The flyer bow of claim 11, wherein the cross section includes an airfoil shape.

14. The flyer bow of claim 8, wherein the slot does not extend from the inner surface to the outer surface.

* * * * *